US005795214A

United States Patent [19]

Leon

[11] Patent Number: 5,795,214

[45] Date of Patent: Aug. 18, 1998

[54] THRUST BALANCED TURN BASE FOR THE NOZZLE ASSEMBLY OF AN ABRASIVE MEDIA BLASTING SYSTEM

[75] Inventor: Ross M. Leon, Cincinnati, Ohio

[73] Assignee: Cold Jet, Inc., Loveland, Ohio

[21] Appl. No.: 813,114

[22] Filed: Mar. 7, 1997

[51] Int. Cl.[6] ..... B24C 5/04

[52] U.S. Cl. ..... 451/102; 451/99; 239/654

[58] Field of Search ..... 451/99, 101, 102; 137/561 A; 251/118; 239/336, 379, 654, 8, 9, 530, 548

[56] References Cited

U.S. PATENT DOCUMENTS

| | | | |
|---|---|---|---|
| 1,976,340 | 10/1934 | Gretschel . | |
| 2,569,588 | 10/1951 | Terry et al. . | |
| 3,202,318 | 8/1965 | Black . | |
| 3,240,533 | 3/1966 | Mommsen . | |
| 3,256,642 | 6/1966 | Fonti . | |
| 3,770,200 | 11/1973 | Bauer et al. . | |
| 3,924,809 | 12/1975 | Troup . | |
| 4,265,840 | 5/1981 | Bahler . | |
| 4,299,553 | 11/1981 | Swaroop | 137/561 A |
| 4,512,368 | 4/1985 | Kaminaka et al. | 137/561 A |
| 4,744,181 | 5/1988 | Moore et al. . | |
| 4,843,770 | 7/1989 | Crane et al. . | |
| 4,947,592 | 8/1990 | Moore et al. . | |
| 5,018,667 | 5/1991 | Lloyd . | |
| 5,050,805 | 9/1991 | Lloyd et al. . | |
| 5,063,015 | 11/1991 | Lloyd et al. . | |
| 5,109,636 | 5/1992 | Lloyd et al. . | |
| 5,188,151 | 2/1993 | Young et al. . | |
| 5,301,509 | 4/1994 | Lloyd et al. . | |
| 5,328,517 | 7/1994 | Cates et al. . | |
| 5,473,903 | 12/1995 | Lloyd et al. . | |
| 5,571,335 | 11/1996 | Lloyd . | |

*Primary Examiner*—Timothy V. Eley
*Assistant Examiner*—Derris H. Banks
*Attorney, Agent, or Firm*—Frost & Jacobs LLP

[57] ABSTRACT

A thrust balanced turn base for changing the direction of a fluid flow containing entrained abrasive media is provided. The turn base includes an elongated member having an inlet for the fluid flow with the entrained abrasive media. The turn base further includes a first internal passageway that extends in a downstream direction from the inlet. The first passageway includes a first throat, a converging portion between the inlet and the throat, a diverging portion extending downstream from the throat, an additional converging portion downstream from the diverging portion, a turning portion downstream from the additional converging portion that converges to a second throat and that leads to a nozzle that conducts the fluid flow containing the entrained abrasive media in an angled direction relative to the long axis of the turn base. The turn base also includes a second internal passageway that is in fluid communication with the first internal passageway at an aperture in the first internal passageway located between the inlet and the first throat. The second internal passageway includes a first portion that extends from the aperture and a second gentlely diverging portion that extends from the first portion and that terminates abruptly in a second nozzle that is oriented at about 90° to the long axis of the turn base. The first portion of the second passageway is configured to divert a portion of substantially abrasive media-free fluid flow from the first internal passageway. The second nozzle is oriented and sized so that the thrust of the entrained abrasive media flow from the first nozzle is substantially counter balanced by the thrust of the abrasive media-free flow from the second nozzle.

8 Claims, 2 Drawing Sheets

THRUST BALANCED TURN BASE FOR THE NOZZLE ASSEMBLY OF AN ABRASIVE MEDIA BLASTING SYSTEM

TECHNICAL FIELD

The present invention relates generally to a device for changing the direction of a fluid flow containing entrained abrasive media, and more particularly to such a device which separates from the fluid flow containing entrained abrasive media a fluid flow substantially free of the entrained abrasive media which is so directed as to counterbalance the thrust of the flow containing the entrained media.

BACKGROUND OF THE INVENTION

Fluid flow with entrained abrasive media is well known and can be found in numerous systems in a wide variety of uses. One example of fluid flow with entrained abrasive media is found in the field of pellet blasting used in industrial cleaning systems.

A typical abrasive media blasting industrial cleaning system comprises a transport fluid, such as a gas together with a source of abrasive media to be entrained in the transport fluid. Generally, a hose is connected to a source of compressed air and means are provided to introduce the abrasive media into the hose to be entrained in the compressed air. The hose is connected to a nozzle assembly which accelerates the abrasive media against the surface to be treated. At its forward end, the nozzle assembly is provided with a turn base to change the direction of the flow of fluid containing the entrained abrasive media. The turn base is provided with a nozzle by which the turned fluid flow with entrained abrasive media is directed against the surface to be treated. The nozzle may be an integral part of the turn base, or a separate part.

In many applications, it is necessary to control the direction of the fluid flow containing the entrained abrasive media. Preferably, when space permits, such turning of entrained abrasive media flow is accomplished through large gentle bends in the delivery hose. However, in many applications, space constraints require tight or abrupt turns when, for example, the workpiece or target is in an area having restricted access. Examples of this include cleaning of rubber or plastic mold plates, the cleaning of the interiors of tanks, the cleaning of the interior of brake molds and the removal of surface coatings in tight places. A nozzle for turning fluid flow with entrained abrasive media is taught in co-pending application Ser. No. 08/656,373, filed May 31, 1996 in the names of Tony R. Lehnig, Frederick C. Young, and David R. Linger, and entitled TURN BASE FOR ENTRAINED PARTICLE FLOW. The teachings of this reference are incorporated herein by reference. Briefly, the reference teaches a turn base for a nozzle assembly capable of changing the direction of a fluid flow containing entrained abrasive media. The turn base comprises an inlet, an outlet, a first internal passageway extending downstream from the inlet and a second internal passageway extending in an upstream direction from the outlet. The first and second internal passageways are in fluid communication at a turn. The passageways are configured for slowing the speed of at least a portion of the flow of entrained abrasive media adjacent the turn. The turn base also includes a diffusion pocket located downstream from the turn and aligned with the first internal passageway.

While the use of a turn base is advantageous as indicated above, it also creates a problem of its own. The nozzle assembly is generally held at arms length. When the nozzle assembly incorporates a turn base, the blasting nozzle attached to the turn base directs fluid flow with entrained abrasive media in a direction at an angle to the long axis of the nozzle assembly creating a torque about the operator's shoulders. This low level constant torque is extremely fatiguing for an operator who must counteract the torque, often over extended periods of cleaning. The turn base of the present invention provides a counterbalancing jet of abrasive media-free fluid flow.

The turn base of the present invention and its internal flow path are applicable as described to any blast media except those which are so abrasive that they erode the flow path at the 90 degree turn. Non-limiting examples include walnut shells, wheat starch, plastic beads, etc. In a case of more abrasive media such as glass bead, aluminum oxide or sand, it will be necessary to shield portions of the internal passages of the turn block with abrasia resistant materials such as silicon carbide. However, because of the low fluid velocities inside the passages of the turn block, once this is done the wear rate of the internal passages will be negligible. The actual supersonic nozzle of the device would need to be of a removable ceramic sandblast nozzle construction as is well known in the industry.

Recent years have seen significant growth in the use of sublimable abrasive media such as frozen $CO_2$ (dry ice) pellets. Blast cleaning apparatus using sublimable abrasive media are well known in the industry. U.S. Pat. No. 4,947,592, the teachings of which are incorporated herein by reference, describes in detail a blast cleaning apparatus in which carbon dioxide pellets are formed and introduced into a flow of high pressure transport gas. The carbon dioxide pellets are carried, entrained in the transport gas, through a hose connected to a nozzle assembly which terminates in a discharge nozzle at its exit end. Flow of the entrained carbon dioxide pellets is directed by the nozzle at a particular workpiece so as to perform some function thereon, such as cleaning, coating removal, deflashing, or the like.

Because the frozen carbon dioxide pellets sublimate after contact with the surface being cleaned, there is no resultant accumulation of spent blasting media such as that associated with sand or glass bead grit blasting systems. Accordingly, by using the sublimable pellets in the blast cleaning system, the quantity of contaminated waste product is limited to essentially the actual material being removed or cleaned from the surface of the workpiece. Additionally, because the carbon dioxide pellets are extremely cold (on the order of −109° F.), the carbon dioxide pellet cleaning system works particularly well in cases where the item to be cleaned is relatively hot, due to the large thermal gradient (often referred to as thermal shock), produced in the contaminant that is to be removed. This large thermal gradient helps to break up and loosen many contaminants. For example, in the rubber molding industry, rubber molds are generally held to a temperature of about 300° F., and can be cleaned quite effectively while still in the molding press with carbon dioxide pellet blasting.

From the above, it is clear that a need exists for a nozzle assembly that delivers a blast stream at an angle with respect to its long axis and that does not produce an undesirable torque to be counteracted by the operator. Such a nozzle assembly would be able to deliver a blast of transport fluid with entrained pellets over a wide range of pressures and flow rates with only negligible resultant undesirable torque.

DISCLOSURE OF THE INVENTION

Accordingly, it is a primary object of the present invention to provide a thrust balanced turn base for inducing an angular change in direction (i.e. turning) of a fluid flow of entrained abrasive media that substantially eliminates undesirable torque on an operator's arm and/or shoulders during blasting operations.

It is another object of the present invention to provide a thrust balanced turn base for entrained abrasive media flow for a blast cleaning apparatus that results in a more ergonomically acceptable blast system.

It is yet another object of the present invention to provide a thrust balanced turn base for entrained pellet flow for an abrasive media blast system that can be operated over a wide range of pressures, flow rates, and pellet delivery angles with desirable thrust cancellation.

It is still a further object of the present invention to provide a thrust balanced turn base for entrained abrasive media flow that effectively separates an amount of substantially abrasive media-free transport fluid from the main flow of transport fluid containing entrained abrasive media for use in offsetting or cancelling undesirable thrust forces that result from turning the entrained abrasive media flow stream.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, there is provided a thrust balanced turn base for entrained abrasive media flow for changing the direction of a fluid flow containing entrained abrasive media, having an inlet, an entrained abrasive media flow outlet, a thrust balancing fluid outlet, a first internal passageway extending in a downstream direction from the inlet, the first internal passageway having a throat, the first passageway further having a converging section between the inlet and the throat, the entrained abrasive media fluid flow through the converging section being subsonic. The first internal passageway further including a diverging section extending downstream from the throat. The first passage has a constant cross-section portion extending downstream from the diverging portion and terminating in a gently converging portion extending to a turning flow path portion and a nozzle. A second internal passageway is located in the turning block, in fluid communication with the first passageway at an intersecting aperture disposed between the inlet and the throat of the first passageway. The second internal passageway extends in a downstream direction from the intersecting aperture, the initial part of the second internal passageway has an angled scoop-like configuration so as to divert an amount of transport fluid from the first passageway into the second internal passageway, the angled scoop further being of a configuration so as not to divert a substantial amount of entrained abrasive media from the first internal passageway into the second internal passageway. The second internal passageway terminates in an abruptly turned thrust balancing fluid outlet or nozzle. The thrust balancing fluid outlet is disposed at an angle of approximately 90 degrees with respect to the second internal passageway, so that the thrust component of the entrained pellet flow exiting at the entrained abrasive media flow outlet is substantially counterbalanced by an opposing flow of transport fluid exiting the thrust balancing fluid outlet.

BRIEF DESCRIPTION OF THE DRAWINGS

The accompanying drawing incorporated in and forming a part of the specification illustrate several aspects of the present invention, and together with the description and claims serve to explain the principles of the invention. In the drawing:

DETAILED DESCRIPTION OF THE INVENTION

Figure 1:
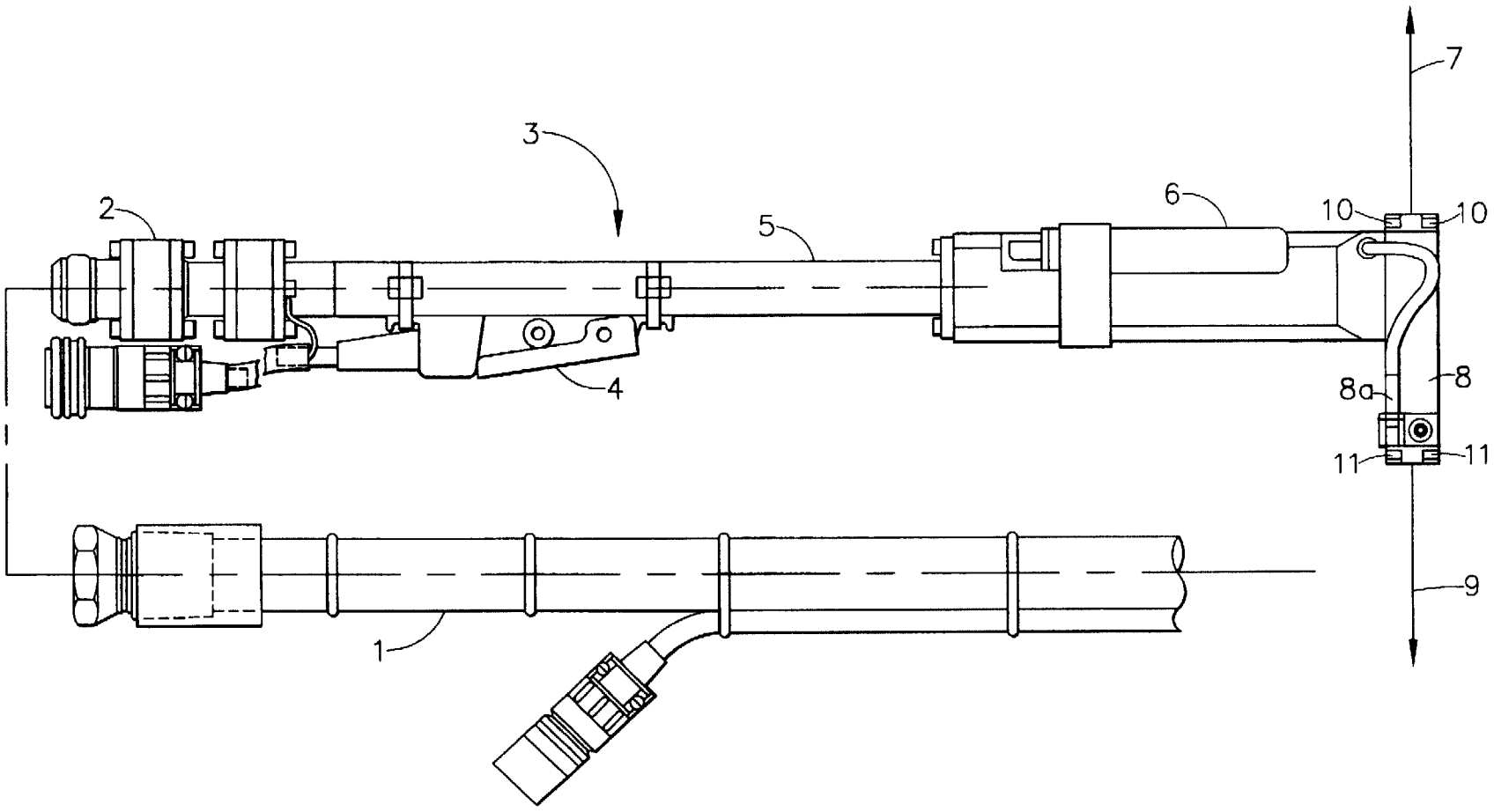
FIG. 1 is a fragmentary elevational view of a hose and an exemplary nozzle assembly provided with the thrust balancing entrained abrasive media flow turn base of the present invention.

In all of the drawings, like parts have been given like index numerals. For purposes of an exemplary showing, the invention will be described in terms of the use of a sublimable abrasive media, such as $CO_2$ pellets. The invention is not intended to be so limited, however. Turning first to FIG. 1, the Figure illustrates a flexible hose 1. The hose 1 is connected to a source (not shown) of pressurized air. The hose is also connected to a mechanism (not shown) which inserts sublimable pellets at a regulated flow rate into the stream of pressurized air within the hose.

The hose 1 is connected by a rotary union 2 to a nozzle assembly generally indicated at 3. The rotary union 2, located at the rearward end of nozzle assembly 3, provides relief of hose torsion and permits the operator to rotate the nozzle assembly to any rotative position relative to hose 1. The nozzle assembly 3 is nonlimiting and exemplary only. Many nozzle assemblies suitable for use with the turnblock of the present invention are known.

The length of the nozzle assembly may be adjusted by the use of modular tube elements, one of which is shown at 5. Greater length may be desired in cleaning the inside of tanks or the like. By virtue of the thrust balancing feature of the present invention, added length does not contribute to a torque problem.

At its forward end, the nozzle assembly is provided with the turn base 6 of the present invention. The turn base 6 has at its forward end an outlet for the counterbalancing, substantially pellet-free, transport fluid 7 and a nozzle 8 for discharging the blast 9 of the transport fluid containing the sublimable pellets. About the outlet for the counterbalancing fluid, the turn base is provided with a series of soft bumpers 10. Similarly, the free end of nozzle 8 is provided with a series of soft bumpers 11. The bumpers 10 and 11 protect the object being cleaned from damage in case of impact. The turn base 6 and nozzle 8 may also be provided with a light source **8*a*** to illuminate the area being cleaned or stripped. Finally, the nozzle assembly may be provided with appropriate handles or grips (not shown), as is known in the art.

Figure 2:
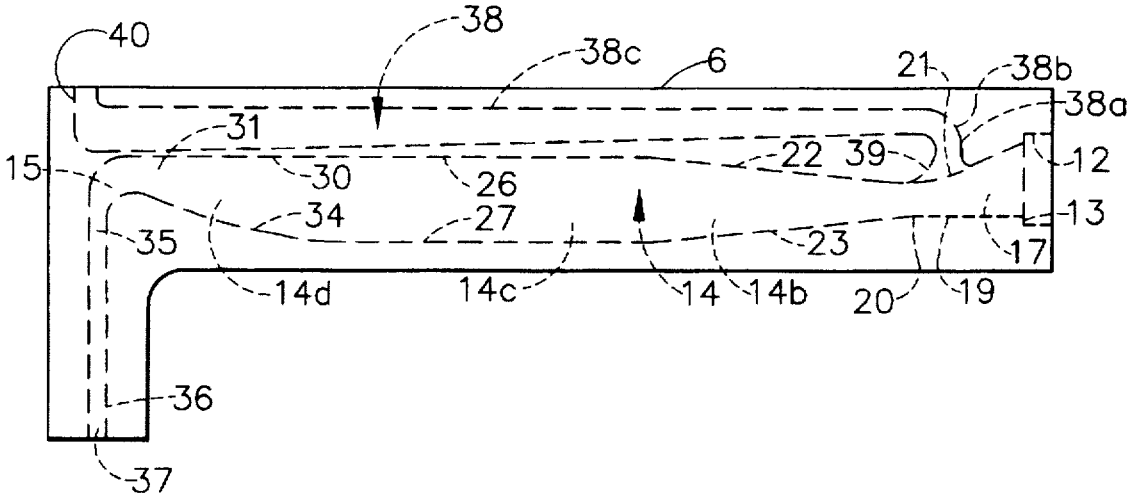
FIG. 2 is a side elevational view of the turn base of the present invention.
Figure 3:
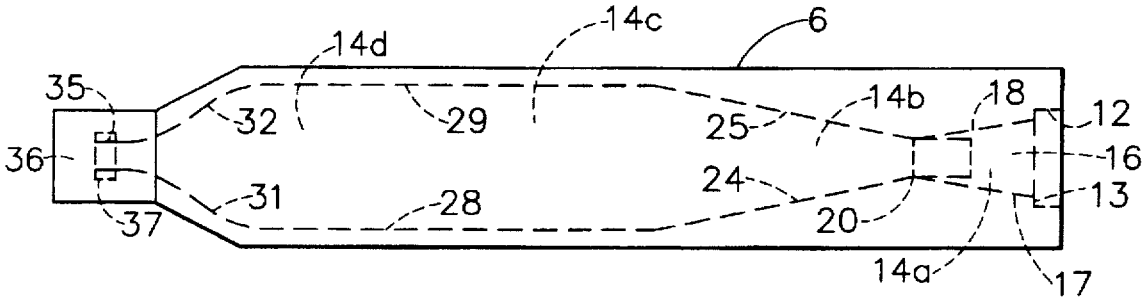
FIG. 3 is a bottom view of the turn base of the present invention.

Reference is now made to FIGS. 2 and 3. The turn base 6 is provided with an inlet opening 12 having a shoulder 13 and intended to receive the forward end of the tubular portion of the nozzle assembly, such as the modular tube element 5. It will be understood that other configurations could be used suitable for the particular type of connection employed.

The inlet 12 leads to a first passage, generally indicated at 14, which terminates in a turning flow path portion 15. That portion of the first passage 14 adjacent the inlet 12 and designated 14a is a converging portion. It will be noted that the top surface 16 and the side surfaces 17 and 18 converge, while the bottom surface 19 of the portion 14a remains horizontal (as viewed in FIGS. 2 and 3). The convergent portion 14a terminates in a throat 20. The converging portion 14a accelerates the air and pellets to a moderately high speed so that the momentum of the pellets carries the pellets past the opening 21 in the top surface 16 of converging portion 14a. The purpose of opening 21 will be apparent hereinafter. An air speed of from about 200 to about 400 ft./sec. at throat 20 will generally be adequate for $CO_2$ pellets. A higher speed will be required for aluminum oxide pellets or sand. Immediately downstream of throat 20, the first passage has a divergent portion indicated at 14b. In this portion, the top and bottom surfaces 22 and 23 and the side surfaces 24 and 25 diverge as shown in FIGS. 2 and 3. The divergent portion 14b decelerates the entrained pellets to a pellet speed of about 25 to about 75 ft./sec. prior to their reaching the turning flow path portion 15. Following the divergent portion 14b, the first passage 14 has a constant cross-section portion 14c. In this portion the $CO_2$ pellets achieve the desired speed, the pellets taking longer to slow down than does the air. In this portion, the top and bottom surfaces 26 and 27 are parallel and horizontal, as viewed in FIG. 2. In a similar fashion, the sides 28 and 29 are also parallel. The size and length of portion 14c is chosen so as to decelerate the blast media to low speeds so that subsequent impact with the walls of the turning flow path 15 will damage neither the blast media nor the walls themselves.

The portion 14c of uniform cross-section leads to a convergent portion 14d which leads directly to the turning flow path portion 15. It will be noted that the top surface 30 of the portion 14d constitutes an extension of top surface 26 and remains horizontal as viewed in FIG. 2. The side surfaces 31 and 32 converge as is most clearly shown in FIG. 3. The bottom surface 34 starts to converge toward top surface 30 before the sides 31 and 32 begin to converge. The bottom surface 34 is a long gentle curve of varying radius along its length. The purpose of the curve is to make the slowest and gentlest transition to the turning flow path portion 15 as is possible within the available length of the turn base 6.

All of the walls making up the turning flow path portion 15 gently converge to form a second throat 35. The throat 35 must be smaller than throat 20. The throat 35 leads to a gently diverging supersonic nozzle 36 in the particular embodiment illustrated. The outer opening 37 of nozzle 36 has a width about 1.45 times the width of throat 35. This is clearly shown in FIG. 3.

The purpose of the converging portion 14d and the reason that the turning flow path 15 is convergent is to enable the sublimable abrasive media entrained flow from nozzle 35 will achieve the desired discharge within the restrictive dimensions of the turn block and the nozzle 35.

It is within the scope of the present invention to make the nozzle 36 a separate part appropriately attachable to turn base 6. The nozzle 36 may have any appropriate shape characteristics commensurate with the available pressure.

The cross-sectional configuration of the first passage 14 may be obround, with the semicircular sides in the constant cross-section portion 14c having a radius approximating the radius of inlet 12. It will be appreciated that different inlet shapes and cross-sectional area profiles may be used to match the particular operating parameters and the operating envelope. For example, the cross-sectional area profile of the first internal passageway 14 could be circular, elliptical, rectangular, or a wide variety of other shapes. The side surfaces and the top and bottom surfaces could be planar with the corners therebetween being rounded.

The opening 21 is of a bell mouth shape leading to a second passage in said turn base, the second passage being generally indicated at 38. The initial part 38a lies at substantially 90 degrees to the overall axis of first passage 41. The portion 38a of passage 38 leads to a 90 degree turning portion 38b which, in turn, leads to a portion 38c having a substantially horizontal axis as viewed in FIG. 2. The bell mouth shaped opening 21 acts as a scoop diverting a portion of the transfer fluid in the initial part of the first passage 14 into the passage 38. The wall portion 39 adjacent opening 21 tends to cause any pellets which hit wall portion 39 to return to the transport fluid stream of first passage 14. Wall portion 39 lies at an angle of about 40° to the long axis of the turn base. The portion 38c of passage 38 is a gently diverging or diffusing passage to minimize pressure loss. The portion 38c of passage 38 terminates abruptly in a converging (or converging-diverging) nozzle 40, the axis of which is substantially perpendicular to the long axis of the turn base. The transition from portion 38c of passage 38 to nozzle 40 is abrupt because of the size constraints of the turn base. No harm is done by this abrupt transition since the fluid transport material in passage 38 is substantially devoid of pellets. The area of the throats of nozzles 36 and 40 are sized so that the thrust levels produced by the jets from each nozzle approximately cancel each other producing essentially no net thrust on the nozzle assembly in a direction angularly related to the long axis of the nozzle assembly.

In a preferred embodiment of the present invention, approximately 45% of the pressurized air is directed to the counterbalancing stream, and 55% of the pressurized air is directed to the transfer stream with entrained abrasive media. This provides a thrust balance, given the pressure losses experienced by each stream. The counterbalancing stream experiences less pressure loss because there is no abrasive media tumbling through the counterbalancing stream. In a preferred embodiment, the overall flow rate of the nozzle is approximately 200 SCFM at 80 psig supply pressure. This pressure was chosen because it represents a pressure that most industrial plant compressed air supplies are capable of delivering to a blast cleaning unit without costly modification.

The turn base 6 is preferably made of two substantially mirror image aluminum parts welded together. The turn base could be molded of plastic.

While the turn base illustrated turns the transfer fluid flow with entrained abrasive media 90 degrees to the long axis of the nozzle assembly 3, the teachings of the present invention can be applied for any angle ranging from about 30 degrees to about 150 degrees. It will be understood that the flow split between the compensating jet and the jet containing entrained abrasive media must be adjusted to provide cancellation of thrust at the desired angle of the jet containing entrained pellets. This is generally accomplished by appropriately sizing the throat of the compensating jet nozzle. At angles outside the above-given range, the thrust will be oriented more nearly toward or away from the operator, and sideways thrust and resultant torque will not be a significant problem. Tests of the nozzle assembly of the present invention have shown that an operator can hold the nozzle assembly at the trigger with the fingers of one hand while blasting at arms length. With a conventional system wherein the transfer fluid flow carrying the entrained abrasive media was turned 90 degrees to the long axis of the nozzle assembly, a firm grip with both hands of the operator is required to control the nozzle.

Modifications of the invention can be made without departing from the spirit of it.

what is claimed:

1. A thrust balanced turn base for changing the direction of a fluid flow containing entrained abrasive media; said turn base comprising an elongated member having an inlet for said fluid flow with entrained abrasive media, a first internal passageway extending in a downstream direction from said inlet, said first passageway comprising a first throat, a first converging portion between said inlet and said first throat, a diverging portion extending downstream from said first throat, a second gently converging portion downstream of said diverging portion, a turning portion downstream of said second converging portion converging to a second throat and leading to a first nozzle conducting said fluid flow containing entrained abrasive media in a direction angularly related to a long axis of said turn base, a second internal passageway in fluid communication with said first internal passageway at an aperture in said first internal passageway located between said inlet and said first throat, said second internal passageway having a first portion extending from said aperture and a second gently diverging portion extending from said first portion and terminating abruptly in a second nozzle oriented at about 90° to the long axis of said turn base, said first portion of said second internal passageway being configured to divert a substantially abrasive media-free part of said fluid flow from said first internal passageway into said second internal passageway, said second nozzle being oriented and sized so that the thrust of said entrained abrasive media flow from said first nozzle is substantially counterbalanced by the thrust of said abrasive media-free flow from said second nozzle.

2. The turn base claimed in claim 1 wherein said first internal passageway includes a portion of constant cross-section between said diverging portion and said second converging portion.

3. The turn base claimed in claim 1 wherein said fluid flow containing abrasive media is directed by said first nozzle at an angle to said long axis of said turn base within the range of from about 30° to about 150°.

4. The turn base claimed in claim 1 wherein said first nozzle directs said fluid flow with entrained abraisve media at an angle of 90° to said long axis of said turn base.

5. The turn base claimed in claim 1 wherein said first portion of said second internal passageway is of a bellmouth shape at said aperture providing a scoop-like configuration to divert said substantially abrasive media-free part of said fluid flow into said second internal passage, and providing a forward wall portion disposed at an angle to deflect entrained particles away from said aperture and into said first internal passage.

6. The turn base claimed in claim 1 wherein about 55% of said fluid flow with entrained abrasive media passes through said first internal passage and about 45%, abrasive media-free, is diverted through said second internal passage.

7. The turn base claimed in claim 1 wherein said abrasive media comprises $CO_2$ pellets.

8. The turn base claimed in claim 1 wherein said abrasive media is chosen from the class consisting of glass beads, sand and aluminum oxide.

* * * * *